US011845264B2

(12) United States Patent
Yashita et al.

(10) Patent No.: US 11,845,264 B2
(45) Date of Patent: Dec. 19, 2023

(54) RECORDING DEVICE

(71) Applicant: SEIKO EPSON CORPORATION, Tokyo (JP)

(72) Inventors: Mio Yashita, Shiojiri (JP); Shun Ito, Matsumoto (JP); Keiichi Yato, Matsumoto (JP); Junki Akama, Shiojiri (JP); Atsuhiko Takeuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 2 days.

(21) Appl. No.: 17/646,005

(22) Filed: Dec. 27, 2021

(65) Prior Publication Data

US 2022/0203711 A1 Jun. 30, 2022

(30) Foreign Application Priority Data

Dec. 28, 2020 (JP) ..... 2020-218881

(51) Int. Cl.
*B41J 11/00* (2006.01)

(52) U.S. Cl.
CPC ..... *B41J 11/0085* (2013.01)

(58) Field of Classification Search
CPC ..... B41J 11/0085; B41J 11/0025; B41J 11/06; B41J 11/0065
See application file for complete search history.

(56) References Cited

FOREIGN PATENT DOCUMENTS

JP 2015-027751 A 2/2015
JP 6463232 B2 * 1/2019 ..... B41J 11/0065

OTHER PUBLICATIONS

Kurata, Tetsuharu, Printing Apparatus and Platen, Oct. 16, 2018, CN, All Pages (Year: 2018).*

* cited by examiner

*Primary Examiner* — Justin Seo
*Assistant Examiner* — Tracey M Mcmillion
(74) *Attorney, Agent, or Firm* — WORKMAN NYDEGGER

(57) ABSTRACT

A recessed portion is a portion that is provided to an end of a platen in an X direction and is recessed from the supporting surface of the platen. A discharge portion discharges the ink in the recessed portion along a +Y direction. A width of the discharge portion in an X direction is smaller than a width of the recessed portion in the X direction, and a position of the discharge portion in the X direction is arranged on an inner side with respect to a position of an edge of the roll paper. An end side of the discharge path, which is positioned on an inner side of the roll paper in the X direction, is arranged continuously to an end side of the recessed portion, which is positioned on the inner side of the roll paper, on an extension line of the end side.

12 Claims, 11 Drawing Sheets

RECORDING DEVICE

The present application is based on, and claims priority from JP Application Serial Number 2020-218881, filed Dec. 28, 2020, the disclosure of which is hereby incorporated by reference herein in its entirety.

BACKGROUND

1. Technical Field

The present disclosure relates to a recording device.

2. Related Art

An ink-jet type printing device described in JP-A-2015-27751 includes a reception unit that receives ink discarded during margin-less printing. In the reception unit, an elongated hole to which a negative pressure is applied and a guiding portion for guiding ink to the elongated hole are formed.

In the configuration in which ink flows on a back side of a supporting member for supporting a recording medium as in the device of JP-A-2015-27751, recovered ink may possibly stain a negative pressure generation unit. Thus, it is preferred that the ink flow on a front side of the supporting member.

However, in a configuration in which the ink flows on the front side of the supporting member and on a lower side of the recording medium, when the ink stagnates at a part of a discharge path, overflowing ink possibly stains a back surface of the recording medium.

SUMMARY

In order to solve the above-mentioned problem, a recording device according to the present disclosure includes a recording unit configured to eject a liquid droplet onto a recording medium transported in a transport direction to perform recording, a supporting member being arranged to face the recording unit and including a supporting surface configured to support the recording medium, at least one recessed portion being provided at an end of the supporting member in a width direction intersecting the transport direction and being recessed from the supporting surface, the recessed portion being configured to receive the liquid droplet ejected from the recording unit, and a discharge path being coupled to the recessed portion and being configured to discharge the liquid droplet in the recessed portion along the transport direction, wherein a width of the discharge path in the width direction is smaller than a width of the recessed portion in the width direction, and a position of the discharge path in the width direction is arranged on an inner side with respect to a position of an edge of the recording medium, and a second end side of the discharge path is arranged continuously to a first end side of the recessed portion on an extension line of the first end side, the second end side being positioned on an inner side of the recording medium in the width direction, the first end side being positioned on the inner side of the recording medium.

DESCRIPTION OF EXEMPLARY EMBODIMENTS

Figure 1:
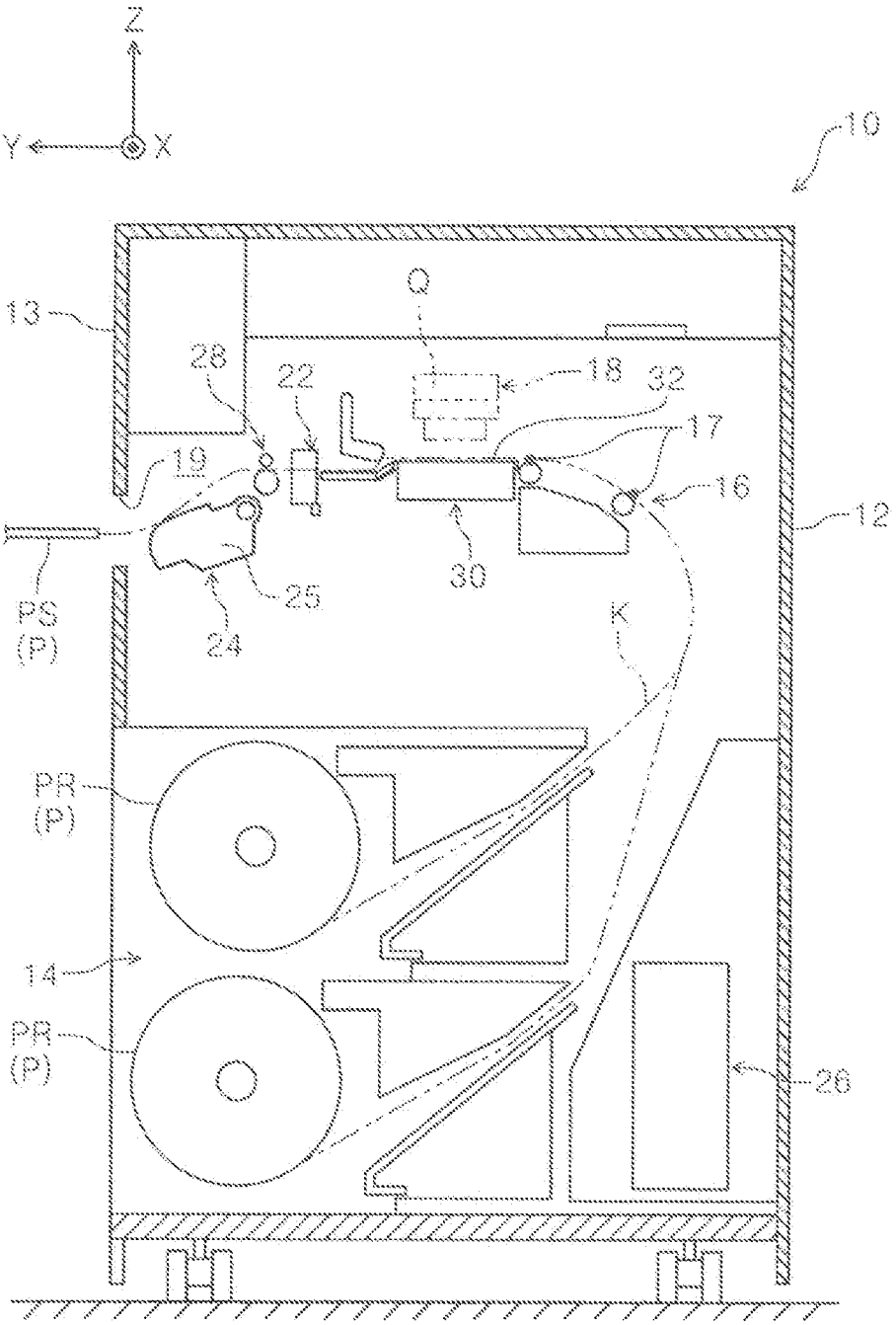
FIG. 1 is an overall configuration view of a printer according to a first exemplary embodiment.

A first aspect to a twelfth aspect of the present disclosure are schematically described below.

In order to solve the above-mentioned problem, a recording device according to a first aspect of the present disclosure includes a recording unit configured to eject a liquid droplet onto a recording medium transported in a transport direction to perform recording, a supporting member being arranged to face the recording unit and including a supporting surface configured to support the recording medium, at least one recessed portion being provided at an end of the supporting member in a width direction intersecting the transport direction and being recessed from the supporting surface, the recessed portion being configured to receive the liquid droplet ejected from the recording unit, and a discharge path being coupled to the recessed portion and being configured to discharge the liquid droplet in the recessed portion along the transport direction, wherein a width of the discharge path in the width direction is smaller than a width of the recessed portion in the width direction, and a position of the discharge path in the width direction is arranged on an inner side with respect to a position of an edge of the recording medium, and a second end side of the discharge path is arranged continuously to a first end side of the recessed portion on an extension line of the first end side, the second end side being positioned on an inner side of the recording medium in the width direction, the first end side being positioned on the inner side of the recording medium.

According to the present aspect, the width of the discharge path in the width direction is smaller than the width of the recessed portion in the width direction on the supporting member. With this, the portion on the outer side in the width direction with respect to the discharge path can be used as a portion for supporting the recording medium. With this, the edge of the recording medium in the width direction can be prevented from hanging down to the recessed portion and the discharge path.

Further, at the portion of the supporting member, which is arranged on the lower side of the recording medium, the second end side of the discharge path is arranged continuously to the first end side of the recessed portion on the extension line of the first end side. With this, the path from the recessed portion to the discharge path has a linear shape.

With this, the liquid droplet in the recessed portion is easily discharged to the outside through the discharge path.

In this manner, the edge of the recording medium in the width direction is prevented from hanging down, and the recessed portion is easily discharged at the same time. With this, the liquid droplet can be prevented from staining a back surface of the recording medium.

In a recording device according to a second aspect, which is based on the first aspect, in a recording device according to a second aspect, the supporting member is provided with a suction portion on an inner side in the width direction with respect to the recessed portion, the suction portion being configured to suck the recording medium, and the suction portion includes at least one suction port into which air flows.

According to the present aspect, when the suction portion sucks the recording medium on the inner side in the width direction with respect to the recessed portion, floating of the recording medium on the supporting member is prevented, and the posture of the recording medium is stabilized. Thus, the edge of the recording medium in the width direction with respect to the recessed portion can be prevented from being deviated. Note that a part of the recessed portion and a part of the discharge path, which are the closest to the suction port, are formed to have a linear shape in the transport direction, and the liquid droplet is easily discharged. Thus, the liquid droplet can be prevented from flowing into the suction port.

In a recording device according to a third aspect, which is based on the first aspect or the second aspect, a region of the supporting member where the recessed portion is provided includes a part of a recording region where the recording unit performs recording on the recording medium in the transport direction, and includes a part of non-recording regions outside of both the edges of the recording medium in the width direction.

According to the present aspect, even when the edge of the recording medium in the width direction is deviated to the inner side in the width direction on the supporting member, the recessed portion provided to a part of the recording region receives the liquid droplet. Thus, the liquid droplet can be prevented from spreading along the supporting surface.

In a recording device according to a fourth aspect, which is based on any one of the first aspect to the third aspect, the recessed portion and the discharge path include a plurality of groove portions extending along the transport direction and being arrayed in the width direction.

According to the present aspect, a cross-sectional area of the flow path through which the liquid droplet flows is smaller than that of a configuration without the groove portion. With this, a capillary phenomenon is easily caused. Thus, the liquid droplet in the recessed portion can easily flow in the transport direction.

In a recording device according to a fifth aspect, which is based on the fourth aspect, the plurality of groove portions in the recessed portion are coupled in the width direction at a downstream end of the recessed portion in the transport direction, and are coupled to the discharge path.

According to the present aspect, the liquid droplet flowing through a portion of the recessed portion, which does not include the discharge path in the transport direction, flows to the discharge path through a portion of the plurality of groove portions coupled in the width direction. With this, the liquid droplet stagnating at the end of the recessed portion in the transport direction can be prevented from overflowing.

In a recording device according to a sixth aspect, which is based on the fourth aspect or the fifth aspect, a first length corresponding to a width of one of the plurality of groove portions in the width direction is smaller than a second length corresponding to an interval between adjacent groove portions of the plurality of groove portions in the width direction.

According to the present aspect, when the width of the groove portion in the width direction is set to be small, a capillary phenomenon of the liquid droplet in the groove portion is easily caused. Thus, the liquid droplet can easily flow in the transport direction.

In a recording device according to a seventh aspect, which is based on any one of the first aspect to the sixth aspect, the recessed portion is provided on the supporting surface at a reference position at which one edge of the recording medium in the width direction is positioned.

According to the present aspect, even when the size of the recording medium is changed, the recessed portion is positioned at the reference position, and hence there is no need to change the position of the recessed portion.

In a recording device according to an eighth aspect, which is based on the seventh aspect, the recording unit is configured to perform recording on the recording medium of a plurality of sizes having different widths in the width direction, and when a plurality of recessed portions are provided, at least one of the recessed portions provided at a position other than the reference position is provided corresponding to a position of another edge of the recording medium in the width direction.

According to the present aspect, the positions of the plurality of recessed portions are determined according to the plurality of sizes of the recording medium. Thus, even when the size of the recording medium is changed, there is no need to change the positions of the recessed portions.

In a recording device according to a ninth aspect, which is based on any one of the first aspect to the eighth aspect, the discharge path extends downstream in the transport direction from the recessed portion.

According to the present aspect, the liquid droplet in the recessed portion flows downstream in the transport direction through the discharge path. Here, as compared to a configuration in which the liquid droplet flows upstream in the transport direction, the liquid droplet flowing through the discharge path is less affected by a resistance force generated by a wind pressure from the periphery of the recording medium advancing in the transport direction. Thus, the liquid droplet can easily flow through the discharge path.

In a recording device according to a tenth aspect, which is based on the ninth aspect, the supporting surface is arranged along a horizontal direction, and each of a first bottom surface of the recessed portion and a second bottom surface of the discharge path is inclined such that a position thereof is lower, in a vertical direction, on a downstream side in the transport direction.

According to the present aspect, the first bottom surface and the second bottom surface are inclined downward in the vertical direction. Thus, the liquid droplet can easily flow through the recessed portion and the discharge path due to an own weight.

In a recording device according to an eleventh aspect, which is based on any one of the first aspect to the tenth aspect, a wall surface positioned at the downstream end of the recessed portion in the transport direction is an inclined surface such that a position thereof is higher, in a vertical direction, on a downstream side in the transport direction.

It is assumed that a part of the downstream edge of the recording medium transported downstream in the transport direction is brought into contact with the wall surface. According to the present aspect, the wall surface is an inclined surface that is inclined upward in the vertical direction. Thus, the part of the downstream edge of the recording medium, which is brought into contact with the wall surface, is guided upward by the inclined surface. With this, as compared to a configuration in which the wall surface is arranged along the vertical direction, the part of the downstream edge of the recording medium can be prevented from being caught by the wall surface.

In a recording device according to a twelfth aspect, which is based on any one of the first aspect to the eleventh aspect, an inner wall surface at an upstream end of the discharge path in the transport direction that is positioned at an outer end of the upstream end in the width direction includes an inclined surface being inclined to increase the width of the discharge path in the width direction as approaching the recessed portion.

According to the present aspect, the flow path area of the discharge path is increased at a position closer to the recessed portion. Thus, the liquid droplet can easily flow from the recessed portion to the discharge path. Further, the inclined surface is formed, and thus an area of a portion brought into contact with the downstream edge of the recording medium in the transport direction is smaller at the downstream end of the recessed portion in the transport direction. Thus, the recording medium that is transported can be prevented from being caught by a part of the recessed portion or a part of the discharge path.

An example of a recording device of the present disclosure is specifically described below.

In each of the drawings, an X direction along an X axis indicates an example of a device width direction of a printer 10 and a width direction of a recording medium that are described later. When a front surface of the device faces a user, a −X direction is a left direction and a +X direction is a right side as viewed from the user.

A Y direction along a Y axis indicates an example of a device depth direction of the printer 10. A +Y direction is a direction from a back surface to the front surface of the device, and indicates an example of a transport direction of a sheet P and a roll paper PR on a platen 30, all of which are described later. A −Y direction is a direction from the front surface to the back surface of the device. The X direction are the Y direction are horizontal directions.

A Z direction along a Z axis is a device height direction of the printer 10 and a vertical direction. A +Z direction is a vertically upper side, and a −Z direction is a vertically lower side. The X direction, the Y direction, and the Z direction are orthogonal to one another. The sheet P is an example of the recording medium. In the following description, distinction is made by referring to the sheet P in a rolled state as the roll paper PR and the sheet P that is cut to have a sheet-like shape as a cutform paper PS.

First Exemplary Embodiment

FIG. 1 illustrates the printer 10 as one example of a recording device of a first exemplary embodiment. A stacking device for stacking the cutform paper PS, which is omitted in illustration, is provided in the +Y direction with respect to the printer 10.

The printer 10 includes a housing 12 having a rectangular parallelepiped shape. Further, as an example, the printer 10 is configured as an ink-jet type printer capable of performing printing on the sheet P having a size from A4 to A0. The printer 10 enables recording on both plain paper and photographic paper.

Figure 2:
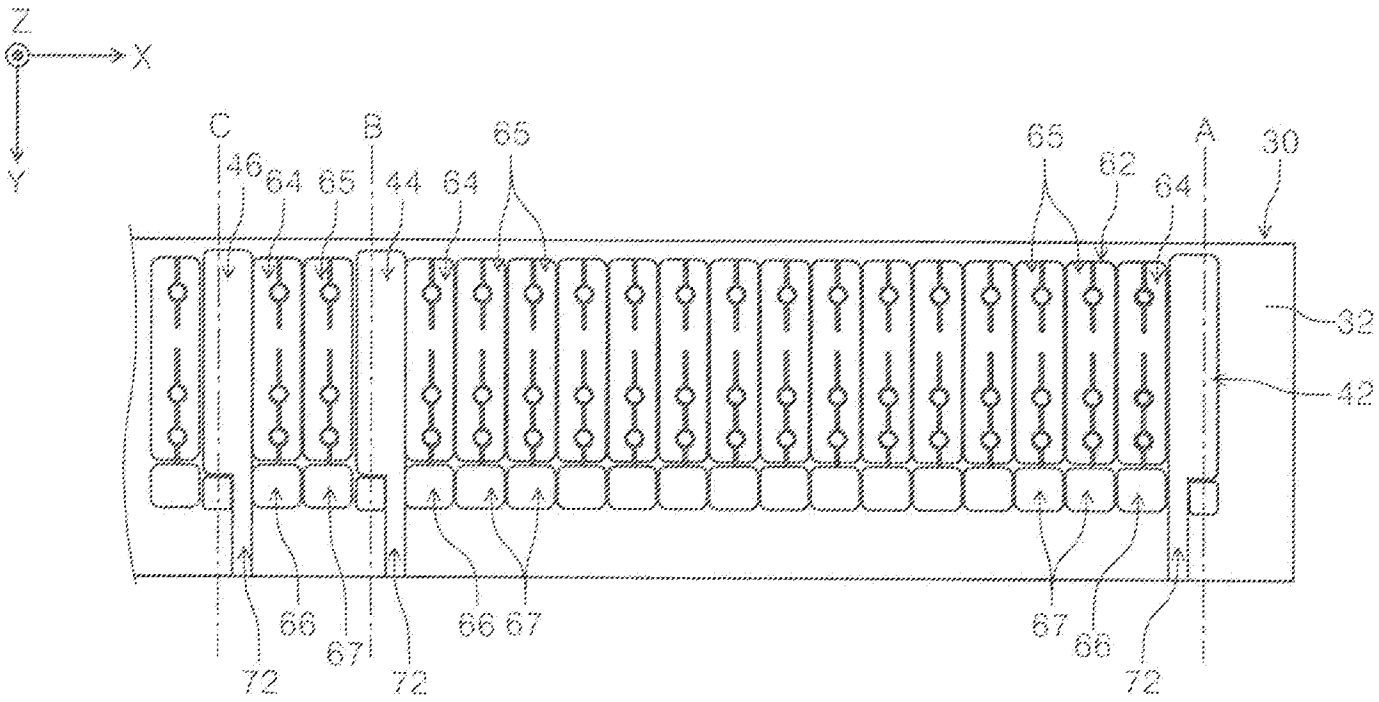
FIG. 2 is a plan view schematically illustrating a platen of the printer according to the first exemplary embodiment.

Specifically, the printer 10 includes, inside the housing 12, a storage unit 14, a transport unit 16, a recording unit 18, a cutting unit 22, a discharge unit 24, a control unit 26, the platen 30, and recessed portions 42, 44, and 46 and a discharge portion 72 provided in the platen 30 (see FIG. 2).

The housing 12 includes a side wall 13 forming a wall portion of the housing 12 in the +Y direction. A discharge port 19 penetrating in the Y direction is formed in the side wall 13. The discharge port 19 has such a size that the sheet P of all types usable in the printer 10 can pass therethrough.

The storage unit 14 stores the roll paper PR rotated about a center axis along the X direction.

The transport unit 16 includes a plurality of transport roller pairs 17. Further, the transport unit 16 transports the roll paper PR, which is drawn out from the storage unit 14, downstream in a transport path K indicated with the two-dot chain line.

The recording unit 18 ejects ink Q being an example of a liquid droplet onto the roll paper PR transported in the +Y direction by the transport unit 16, and thus performs recording. Note that the roll paper PR is transported in the +Y direction in a region facing the recording unit 18. Further, the recording unit 18 is positioned in the +Z direction with respect to the roll paper PR. In other words, recording is performed on an upper surface of the roll paper PR in the +Z direction.

Further, the recording unit 18 is capable of performing margin-less recording on the roll paper PR. The margin-less recording indicates recording performed by ejecting the ink Q onto the entire surface of the roll paper PR, which faces the recording unit 18. Further, the recording unit 18 is capable of performing recording on the roll paper PR of a plurality of sizes having different widths in the X direction.

The cutting unit 22 cuts the roll paper PR after recording performed by the recording unit 18, and thus forms the cutform paper PS.

The discharge unit 24 includes a support 25 and a discharge roller pair 28 that are arranged downstream of the cutting unit 22. The support 25 supports the cutform paper PS, and guides the cutform paper PS to the discharge port 19 at the same time. The discharge roller pair 28 sends the cutform paper PS after cutting onto the support 25. The cutform paper PS discharged from the discharge port 19 is transported to the stacking device that is omitted in illustration.

The control unit 26 controls an operation of each component of the printer 10.

Next, the platen 30, the recessed portions 42, 44, and 46, the discharge portion 72, and the like are described. The platen 30 is arranged to face the recording unit 18, and extends in the X direction. Further, the platen 30 is an example of a supporting member, and includes a supporting surface 32 that supports the roll paper PR. The platen 30 is formed to have a hollow rectangular cylindrical shape, and has a negative pressure chamber inside obtained by discharging air with an air discharge portion omitted in illustration. The length of the platen 30 in the X direction is greater than the length of the roll paper PR in the X direction.

The supporting surface 32 is arranged along an X-Y plane. In other words, the supporting surface 32 is arranged along the horizontal direction.

As illustrated in FIG. 2, the supporting surface 32 includes the recessed portions 42, 44, and 46, a suction portion 62, and the discharge portion 72.

The recessed portions 42, 44, and 46 receive the ink Q ejected from the recording unit 18 (FIG. 1).

The recessed portion 42 is provided at an end of the platen 30 in the +X direction, and is recessed from the supporting surface 32 in the −Z direction. A region in the X direction where the recessed portion 42 is provided includes a reference position A at which the end of the roll paper PR in the +X direction is positioned. In other words, the recessed portion 42 is provided at the reference position A at which one end of the roll paper PR in the X direction is positioned on the supporting surface 32. In FIG. 2, the reference position A in the X direction is indicated with the one-dot chain line A.

The recessed portion 44 is provided at a position away from the recessed portion 42 in the −X direction, and is recessed from the supporting surface 32 in the −Z direction. A region in the X direction where the recessed portion 44 is provided includes a paper edge position B at which an edge of the roll paper PR, which has a small size, in the −X direction is positioned. Note that, as an example, the recessed portion 44 has an axially symmetric configuration with the recessed portion 42 across a line along the Y direction, which is omitted in illustration, as a center. Thus, a specific configuration of the recessed portion 42 is described, and a specific configuration of the recessed portion 44 is omitted in description. In FIG. 2, the paper edge position B and a paper edge position C in the X direction are indicated with the one-dot chain lines B and C.

The recessed portion 46 is provided at a position away from the recessed portion 44 in the −X direction, and is recessed from the supporting surface 32 in the −Z direction. A region in the X direction where the recessed portion 46 is provided includes the paper edge position C at which an edge of the roll paper PR, which has a medium size, in the −X direction is positioned. Note that, as an example, the recessed portion 46 has an axially symmetric configuration with the recessed portion 42 across a line along the Y direction, which is omitted in illustration, as a center. Thus, similarly to the recessed portion 44, a specific configuration of the recessed portion 46 is omitted in description.

As described above, among the recessed portions 42, 44, and 46, the recessed portions 44 and 46 provided at the positions other than the reference position A are provided corresponding to the position corresponding to the other edge of the roll paper PR in the X direction, that is, the edge in the −X direction.

Figure 3:
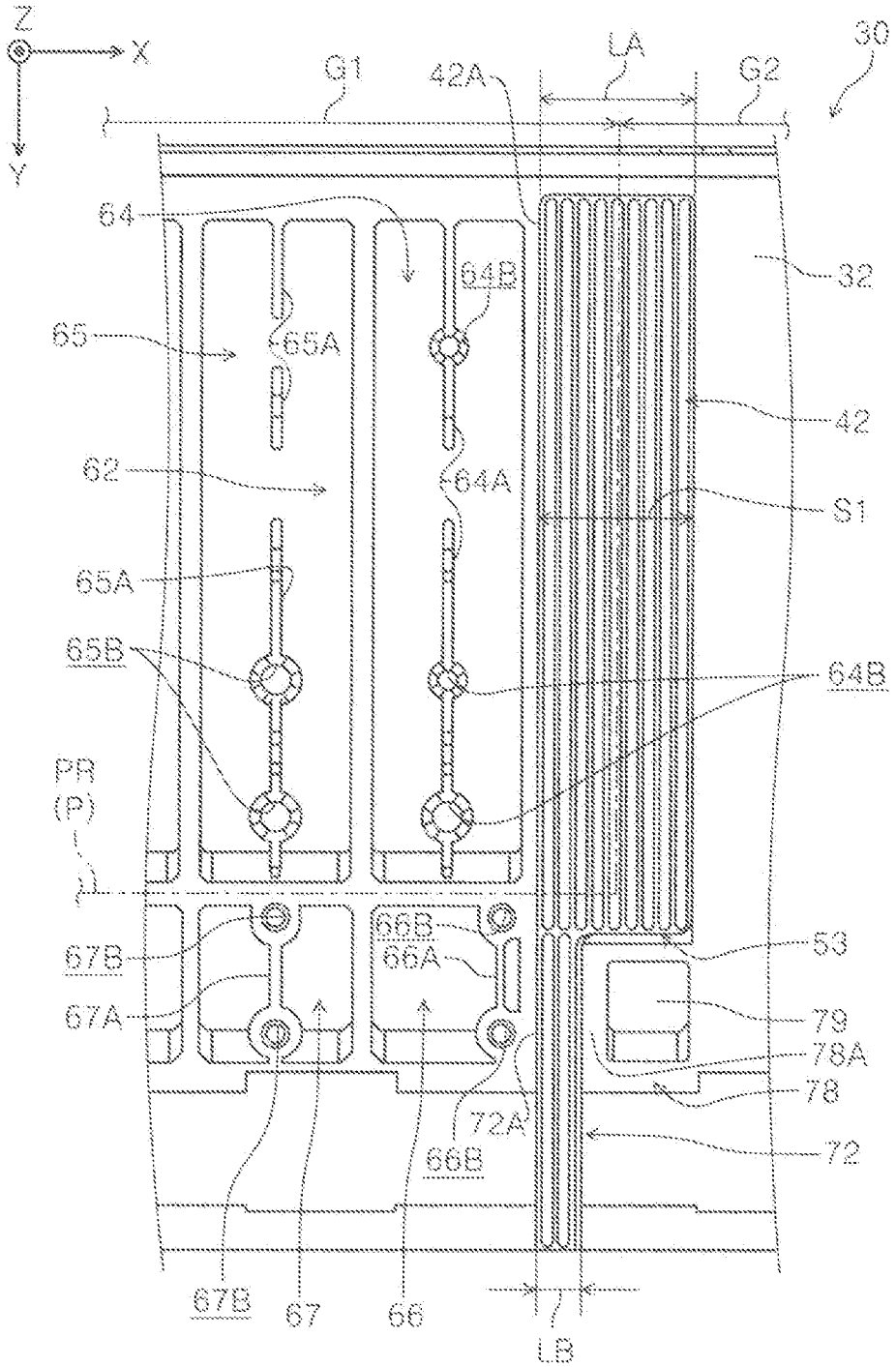
FIG. 3 is a plan view of an end of the platen in a +X direction in the printer according to the first exemplary embodiment.

As illustrated in FIG. 3, as viewed in the +Z direction, the recessed portion 42 has a rectangular shape in which a dimension in the Y direction is greater than a dimension in the X direction. Of end sides of the recessed portion 42, which are positioned on both the ends in the X direction, an end side positioned on an inner side in the −X direction is referred to as a first end side 42A. In other words, the first end side 42A of the recessed portion 42 is positioned on an inner side of the roll paper PR in the X direction. The first end side 42A extends along the Y direction.

A region S1 of the platen 30 where the recessed portion 42 is provided includes a part of a recording region G1 where the recording unit 18 (FIG. 1) performs recording on the roll paper PR in the X direction, and includes a part of non-recording regions G2 outside of both the edges of the roll paper PR in the X direction. Note that a length corresponding to the width of the recessed portion 42 in the X direction is denoted with LA. Further, the length of the recessed portion 42 in the Y direction is greater than a length of a region where the recording unit 18 ejects a liquid droplet.

Figure 5:
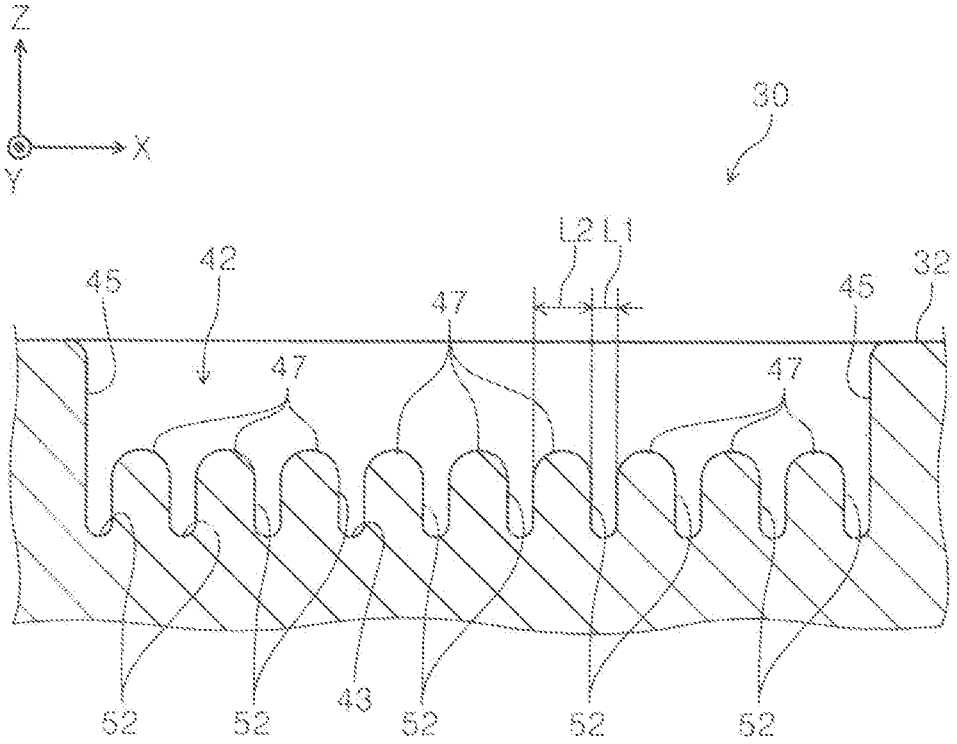
FIG. 5 is a cross-sectional view taken along line 5-5 in FIG. 4.

As illustrated in FIG. 5, the recessed portion 42 includes a first bottom surface 43 and an inner surface 45.

The first bottom surface 43 has a shape similar to that of the recessed portion 42. On the first bottom surface 43, a plurality of rib-like vertical walls 47 standing upright in the +Z direction are formed. As an example, nine vertical walls 47 are formed at an interval in the X direction in the recessed portion 42. A length corresponding to a height of the vertical wall 47 in the Z direction is smaller than a length corresponding to a depth of the recessed portion 42 in the Z direction. In other words, an end surface of the vertical wall 47 in the +Z direction is at a position lower than the supporting surface 32.

Here, it is assumed that a space between the inner surface 45 and the vertical wall 47 and a space between the two vertical walls 47 adjacent to each other are each referred to as a groove portion 52. Specifically, as an example, the recessed portion 42 includes ten groove portions 52.

The groove portions 52 extend along the Y direction, and are arrayed in the X direction. A first length L1 corresponding to a width of one groove portion 52 in the X direction is set to be smaller than a second length L2 corresponding to an interval in the X direction between the groove portions 52 adjacent to each other. In other words, the width of one groove portion 52 in the X direction is smaller than the width of one vertical wall 47 in the X direction. The ten groove portions 52 are connected to each other in the X direction on a downstream end of the recessed portion 42 in the Y direction, and are coupled to the discharge portion 72 (FIG. 3) described later. A portion in which the ten groove portions 52 are coupled in the X direction is referred to as a junction portion 53 (FIG. 4).

Figure 4:
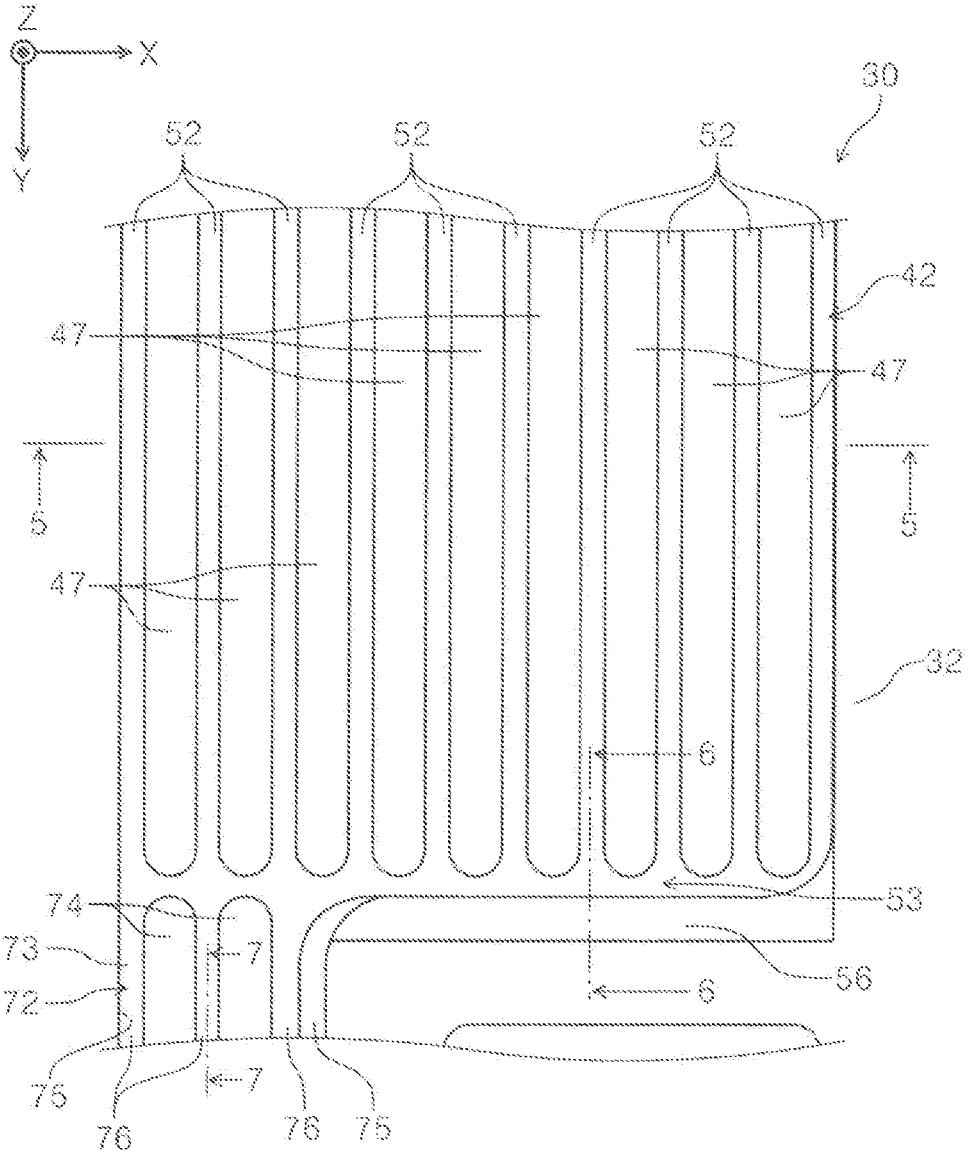
FIG. 4 is a plan view obtained by enlarging a part of a recessed portion of the printer according to the first exemplary embodiment.

As illustrated in FIG. 4, as an example, three groove portions 52, which are positioned close to the end in the −X direction, of the ten groove portions 52 are coupled to three groove portions 76 described later via the junction portion 53 at the downstream end of the recessed portion 42 in the Y direction. Further, the three groove portions 52 and the three groove portions 76 are arrayed linearly in the Y direction. In other words, the three groove portions 52 and the three groove portions 76 are divided by the junction portion 53 in the Y direction. With this, the ink Q flowing through the seven groove portions 52 positioned in the +X direction with respect to the three groove portions 52 is likely to flow in the −X direction at the junction portion 53, and is prevented from stagnating at ends of the seven groove portions 52 in the +Y direction.

Note that, as an example of a wall surface, an inclined surface 56 is formed at a portion of the junction portion 53 in the +Y direction.

Figure 6:
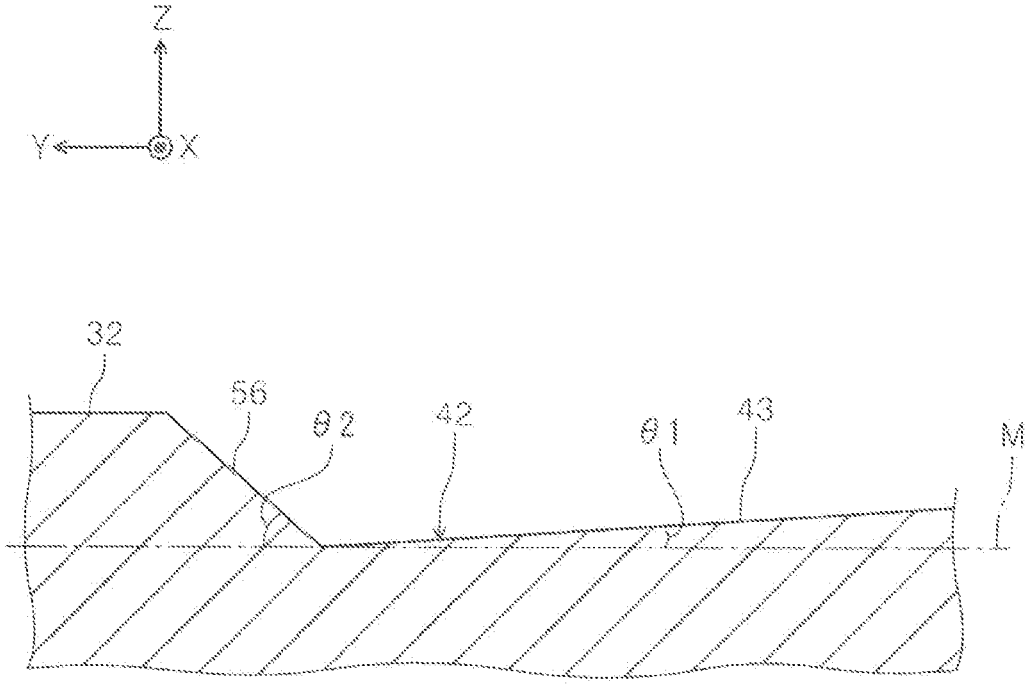
FIG. 6 is a cross-sectional view taken along line 6-6 in FIG. 4.

As illustrated in FIG. 6, the inclined surface 56 is positioned at the downstream end of the recessed portion 42 in the Y direction. Further, a position of the inclined surface 56 in the Z direction is higher as approaching downstream in the Y direction.

A position of the first bottom surface 43 in the Z direction is lower as approaching downstream in the Y direction. In FIG. 6, a horizontal plane M is indicated with the one-dot chain line M. As an example, a first angle θ1 formed between the first bottom surface 43 and the horizontal plane M is smaller than a second angle θ2 formed between the inclined surface 56 and the horizontal plane M.

As illustrated in FIG. 3, the platen 30 includes the suction portion 62 provided on an inner side with respect to the recessed portion 42 in the X direction.

As an example, the suction portion 62 includes a first suction chamber 64, a second suction chamber 65, a third suction chamber 66, and a fourth suction chamber 67. Further, the suction portion 62 sucks the roll paper PR supported on the platen 30.

The first suction chamber 64 is arranged in the −X direction with respect to the recessed portion 42, and is adjacent to the recessed portion 42. A length of the first suction chamber 64 in the Y direction is smaller than a length of the recessed portion 42 in the Y direction. Further, the first suction chamber 64 is recessed from the supporting surface 32 in the −Z direction. In the first suction chamber 64, two ribs 64A and three suction ports 64B are formed. The three suction ports 64B communicate with the inside of the platen 30, and air flows into the suction ports.

A plurality of second suction chambers 65 are arranged in the −X direction with respect to the first suction chamber 64. A length of the second suction chamber 65 in the Y direction is substantially equal to the length of the first suction chamber 64 in the Y direction. Further, the second suction chamber 65 is recessed from the supporting surface 32 in the −Z direction. In the second suction chamber 65, three ribs 65A and two suction ports 65B are formed. The two suction ports 65B communicate with the inside of the platen 30, and air flows into the suction ports.

The third suction chamber 66 is arranged in the +Y direction with respect to the first suction chamber 64, and is adjacent to the junction portion 53 and the discharge portion 72 described later in the −X direction. A length of the third suction chamber 66 in the Y direction is smaller than the length of the first suction chamber 64 in the Y direction. Further, the third suction chamber 66 is recessed from the supporting surface 32 in the −Z direction. In the third suction chamber 66, one rib 66A and two suction ports 66B are formed. The two suction ports 66B communicate with the inside of the platen 30, and air flows into the suction ports. Further, the two suction ports 66B are arranged to be deviated in the +X direction from the center of the third suction chamber 66 in the X direction. With this, floating at the end of the roll paper PR in the +X direction can be prevented.

A plurality of fourth suction chambers 67 are arranged in the −X direction with respect to the third suction chamber 66. A length of the fourth suction chamber 67 in the Y direction is substantially equal to the length of the third suction chamber 66 in the Y direction. Further the fourth suction chamber 67 is recessed from the supporting surface 32 in the −Z direction. In the fourth suction chamber 67, one rib 67A and two suction ports 67B are formed. The two suction ports 67B communicate with the inside of the platen 30, and air flows into the suction ports. Further, the two suction ports 67B are arranged at the center of the fourth suction chamber 67 in the X direction.

The discharge portion 72 is a portion recessed from the supporting surface 32 in the −Z direction. Further, the discharge portion 72 is coupled to a portion of the recessed portion 42, which is positioned in the +Y direction and the −X direction, and extends downward in the Y direction from the recessed portion 42. Further, the discharge portion 72 is an example of a discharge path, and discharges the ink Q in the recessed portion 42 along the +Y direction.

A length LB corresponding to a width of the discharge portion 72 in the X direction is smaller than the above-mentioned length LA. In other words, the width of the discharge portion 72 in the X direction is smaller than the width of the recessed portion 42 in the X direction. The position of the discharge portion 72 in the X direction is arranged on an inner side of the end of the roll paper PR in the +X direction.

Of end sides at both the ends of the discharge portion 72 in the X direction, an end side positioned on an inner side in the −X direction is referred to as a second end side 72A. In other words, the second end side 72A of the discharge portion 72 is positioned on the inner side of the roll paper PR in the X direction. The second end side 72A extends along the Y direction. Further, the second end side 72A is arranged continuously to the first end side 42A on an extension line of the first end side 42A.

In other words, the position corresponding to the end of the discharge portion 72 in the −X direction and the position corresponding to the end of the recessed portion 42 in the −X direction are aligned.

As illustrated in FIG. 4, the discharge portion 72 includes a second bottom surface 73 and an inner wall 75.

On the second bottom surface 73, a plurality of rib-like vertical walls 74 standing upright in the +Z direction are formed. As an example, two vertical walls 74 are formed at an interval in the X direction in the discharge portion 72. A length corresponding to a height of the vertical wall 74 in the Z direction is smaller than a length corresponding to a depth of the discharge portion 72 in the Z direction. In other words, an end surface of the vertical wall 74 in the +Z direction is at a position lower than the supporting surface 32.

It is assumed that a space between the inner wall 75 and the vertical wall 74 and a space between the two vertical wall 74 adjacent to each other are each referred to as the groove portion 76. Specifically, as an example, the discharge portion 72 includes the three groove portions 76.

The groove portions 76 extend along the Y direction, and are arrayed in the X direction. As an example, a length corresponding to a width of one groove portion 76 in the X direction is equal to the first length L1 of one groove portion 52 (FIG. 5). The three groove portions 76 are coupled to the three groove portions 52 in the Y direction via the junction portion 53.

Figure 7:
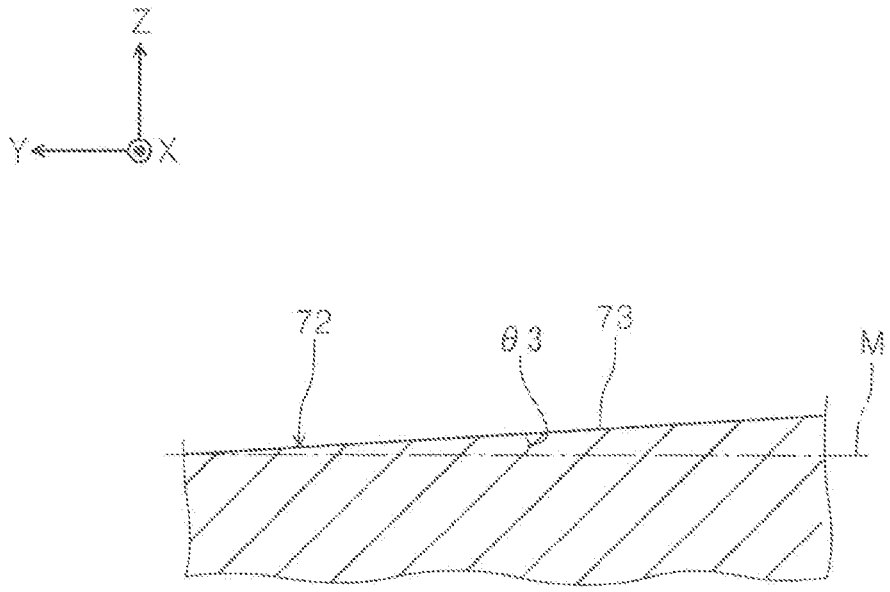
FIG. 7 is a cross-sectional view taken along line 7-7 in FIG. 4.

As illustrated in FIG. 7, the second bottom surface 73 of the discharge portion 72 is inclined such that the position thereof is lower in the Z direction on the downstream side in the Y direction. As an example, a third angle θ3 formed between the second bottom surface 73 and the horizontal plane M is substantially the same as the above-mentioned first angle θ1 (FIG. 6).

As illustrated in FIG. 3, a portion of the supporting surface 32, which is positioned in the +Y direction with respect to the recessed portion 42 and in the +X direction with respect to the discharge portion 72, is regarded as an auxiliary portion 78 having a rectangular shape as viewed in the +Z direction. An upper surface 78A of the auxiliary portion 78 in the +Z direction is at the same height as the supporting surface 32, and is continuous to the supporting surface 32. As an example, a recess 79 is formed in the auxiliary portion 78. The recess 79 is a portion recessed from the supporting surface 32 in the −Z direction.

The upper surface 78A positioned in the −X direction with respect to the center of the auxiliary portion 78 in the X direction is capable of supporting the roll paper PR. Specifically, the auxiliary portion 78 has a function of auxiliarily supporting the roll paper PR on the platen 30 by supporting the end of the roll paper PR in the +X direction, which is transported through the recessed portion 42 in the +Y direction.

Next, actions of the printer 10 of the first exemplary embodiment is described. Note that, for each of the configurations of the printer 10, FIG. 1 to FIG. 7 are referred to, and the individual drawing numbers are omitted in description.

In the printer 10, the width of the discharge portion 72 in the X direction is smaller than the width of the recessed portion 42 in the X direction on the platen 30. Thus, the auxiliary portion 78 being a portion on the outer side in the X direction with respect to the discharge portion 72 can be used as a portion for supporting the roll paper PR. With this, the edge of the roll paper PR in the X direction can be prevented from hanging down to the recessed portion 42 and the discharge portion 72.

Further, at the portion of the platen 30, which is arranged in the −Z direction with respect to the roll paper PR, specifically, on the lower side, the second end side 72A of the discharge portion 72 is arranged continuously to the first end side 42A on the extension line of the first end side 42A of the recessed portion 42. With this, the path from the recessed portion 42 to the discharge portion 72 has a linear shape. With this, the ink Q of the recessed portion 42 is easily discharged to the outside through the discharge portion 72.

In this manner, the edge of the roll paper PR in the X direction is prevented from hanging down, and the ink Q in the recessed portion 42 is easily discharged at the same time. With this, the ink Q can be prevented from staining the back surface of the roll paper PR in the −Z direction.

In the printer 10, when the suction portion 62 sucks the roll paper PR on the inner side in the X direction with respect to the recessed portion 42, floating of the roll paper PR on the platen 30 is prevented, and the posture of the roll paper PR is stabilized. Thus, the edge position of the roll paper PR in the X direction with respect to the recessed portion 42 can be prevented from being deviated. Note that a part of the recessed portion 42 and a part of the discharge portion 72, which are the closest to the suction ports 64B, are formed to have a linear shape in the +Y direction, and the ink Q is easily discharged. Thus, the ink Q can be prevented from flowing into the suction ports 64B.

In the printer 10, even when the edge of the roll paper PR in the X direction is deviated to the inner side in the X direction on the platen 30, the recessed portion 42 provided to a part of the recording region G1 receives the ink Q. Thus, the ink Q can be prevented from spreading along the supporting surface 32.

In the printer 10, a cross-sectional area of the flow path through which the ink Q flows is smaller than that of a configuration without the groove portions 52 and 76. With this, a capillary phenomenon is easily caused. Thus, the ink Q in the recessed portion 42 can easily flow in the +Y direction.

In the printer 10, the ink Q flowing through a portion of the recessed portion 42, which does not include the discharge portion 72 in the +Y direction, that is, the ink Q flowing through the seven groove portions 52 flows through the junction portion 53 to the discharge portion 72. With this, the ink Q stagnating at the end of the recessed portion 42 in the +Y direction can be prevented from overflowing.

In the printer 10, when the width of the groove portion 52 in the X direction is set to be small, a capillary phenomenon of the ink Q in the groove portion 52 is easily caused. Thus, the ink Q can easily flow in the +Y direction.

In the printer 10, even when the size of the roll paper PR is changed, the recessed portion 42 is positioned at the reference position A, and hence there is no need to change the position of the recessed portion 42.

In the printer 10, the positions of the recessed portions 42, 44, and 46 are determined according to the plurality of sizes of the roll paper PR. Thus, even when the size of the roll paper PR is changed, there is no need to change the positions of the recessed portions 42, 44, and 46.

In the printer 10, the ink Q in the recessed portion 42 flows downstream in the Y direction through the discharge portion 72. Here, as compared to a configuration in which the ink Q flows upstream in the Y direction, the ink Q flowing through the discharge portion 72 is less affected by a resistance force generated by a wind pressure from the periphery of the roll paper PR advancing in the +Y direction. Thus, the ink Q can easily flow through the discharge portion 72.

In the printer 10, in a state in which the platen 30 is arranged along the X-Y plane, the first bottom surface 43 and the second bottom surface 73 are inclined downward in the Z direction. Thus, the ink Q can easily flow through the recessed portion 42 and the discharge portion 72 due to an own weight.

It is assumed that a part of the downstream edge of the roll paper PR transported downstream in the Y direction is brought into contact with the inclined surface 56. In the printer 10, the inclined surface 56 is an inclined surface that is inclined upward in the Z direction. Thus, the part of the downstream edge of the roll paper PR, which is brought into contact with the inclined surface 56, is guided upward by the inclined surface 56. With this, as compared to a configuration in which the inclined surface 56 is arranged along the Z direction, the part of the downstream edge of the roll paper PR can be prevented from being caught by the inclined surface 56.

Second Exemplary Embodiment

Next, a printer 80 of the second exemplary embodiment being an example of the recording device is described with reference to the drawings. Note that components that are commonly shared in the printer 10 are denoted with the same reference symbols, and description thereof is omitted.

Figure 8:
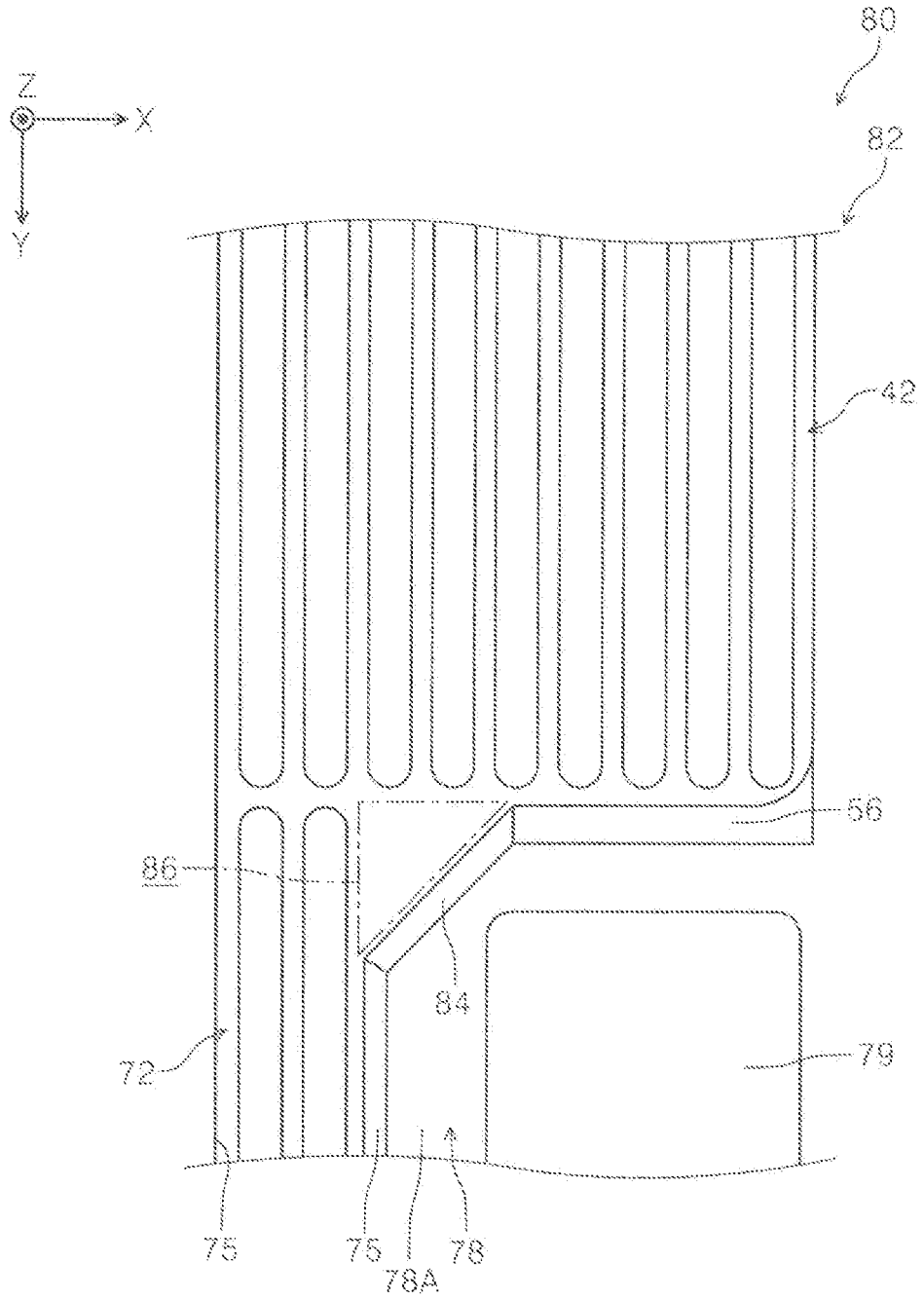
FIG. 8 is a plan view obtained by enlarging a part of a recessed portion of a printer according to a second exemplary embodiment.

FIG. 8 illustrates a part of a platen 82 of the printer 80. The printer 80 has a configuration including the platen 82 in place of the platen 30 of the printer 10 (FIG. 1). The configurations other than the platen 82 are similar to those in the printer 10.

The platen 82 is different from the platen 30 (FIG. 1) in that an inclined surface 84 is formed at a part of the auxiliary portion 78. The other configurations are similar to those of the platen 30.

The inclined surface 56, the inclined surface 84, and the inner wall 75 in the +X direction are formed at an outer periphery of the auxiliary portion 78 as viewed in the +Z direction. The inner wall 75 in the +X direction is an example of an inner wall surface, and is positioned at an outer end (in the X direction) of the upstream end (in the Y direction) of the discharge portion 72.

The inclined surface 84 is inclined so that the width of the discharge portion 72 in the X direction is increased as approaching the recessed portion 42. Specifically, the inclined surface 84 is formed at a position in the −X direction and the −Y direction with respect to the auxiliary portion 78. Further, the inclined surface 84 is inclined the end in the +X direction is positioned in the −Y direction with respect to the end in the −X direction. As viewed in the +Z direction, the inclination angle of the inclined surface 84 with respect to the X direction is approximately 45 degrees as an example.

The inclined surface 84 is formed, and thus a space portion 86 is formed at a position in the −X direction and the −Y direction with respect to the inclined surface 84 on the platen 30. The space portion 86 is formed to have a triangular shape as viewed in the +Z direction.

Next, actions of the printer 80 of the second exemplary embodiment is described.

In the printer 80, the flow path area of the discharge portion 72 on the X-Z plane is increased at a position closer to the recessed portion 42. Thus, the ink Q can easily flow from the recessed portion 42 to the discharge portion 72. Further, the inclined surface 84 is formed, and thus an area of the inclined surface 56 being a portion brought into contact with the downstream edge of the roll paper PR in the +Y direction is smaller at the downstream end of the recessed portion 42 in the +Y direction than that on the platen 30. Thus, the roll paper PR that is transported can be prevented from being caught by a part of the recessed portion 42 or a part of the discharge portion 72.

In this case, the junction portion 53 may be provided along an extension direction of the inclined surface 84.

Figure 9:
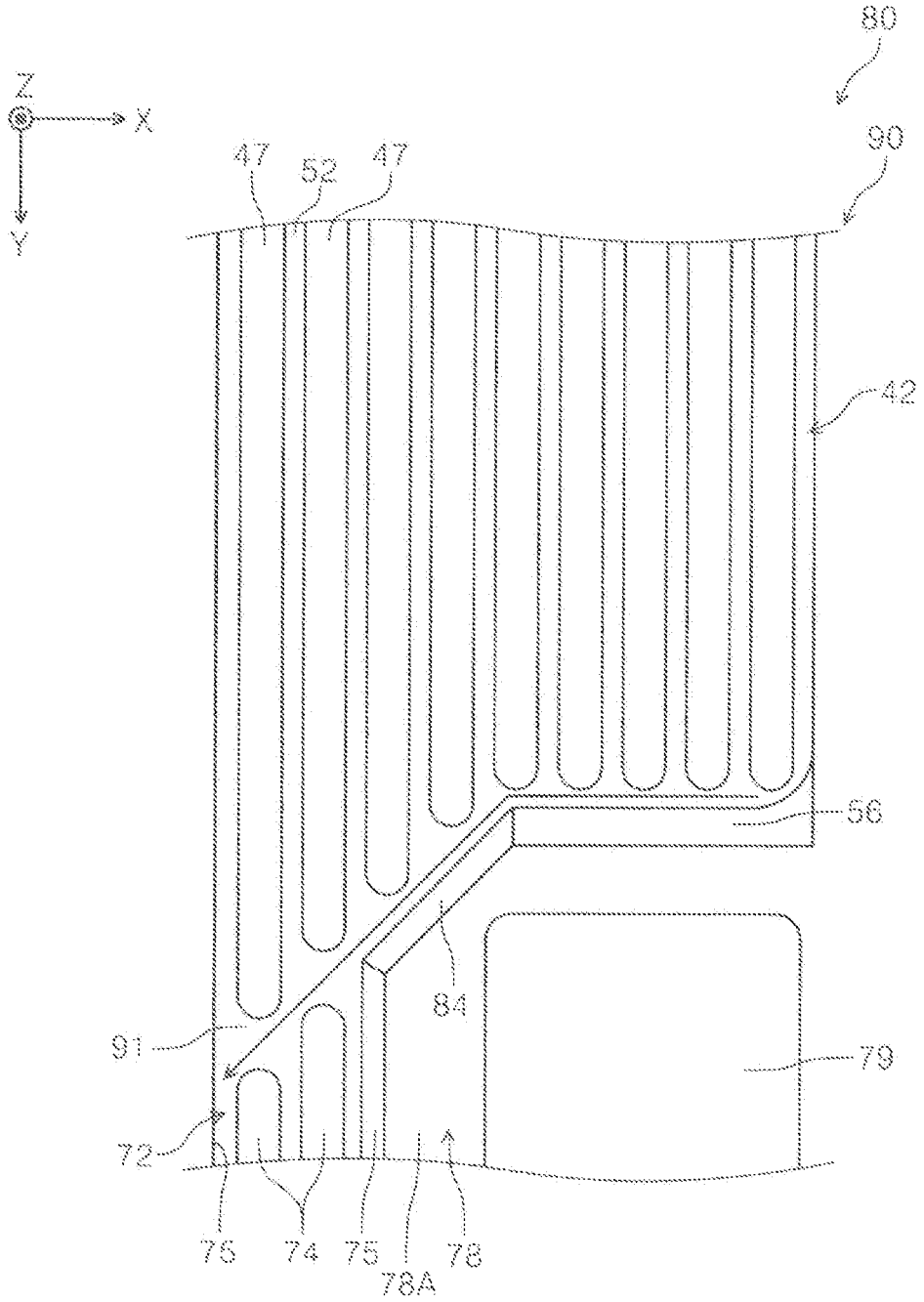
FIG. 9 is a plan view obtained by enlarging a part of the recessed portion of the printer according to a first modification example of the second exemplary embodiment.

FIG. 9 illustrates the printer 80 of a first modification example of the second exemplary embodiment. The printer 80 of the first modification example includes a platen 90. The platen 90 is different from the platen 82 (FIG. 8) in that the lengths of the plurality vertical walls 47 in the Y direction vary. The plurality of vertical walls 47 positioned in the −X direction with respect to the center in the recessed portion 42 have greater lengths in the Y direction as approaching the −X direction. With this, a junction portion 91 between the vertical walls 47 the vertical walls 74 arrayed in the Y direction forms a flow path along the extension direction of the inclined surface 84. The arrow indicates a part of the flow of the ink Q.

Figure 10:
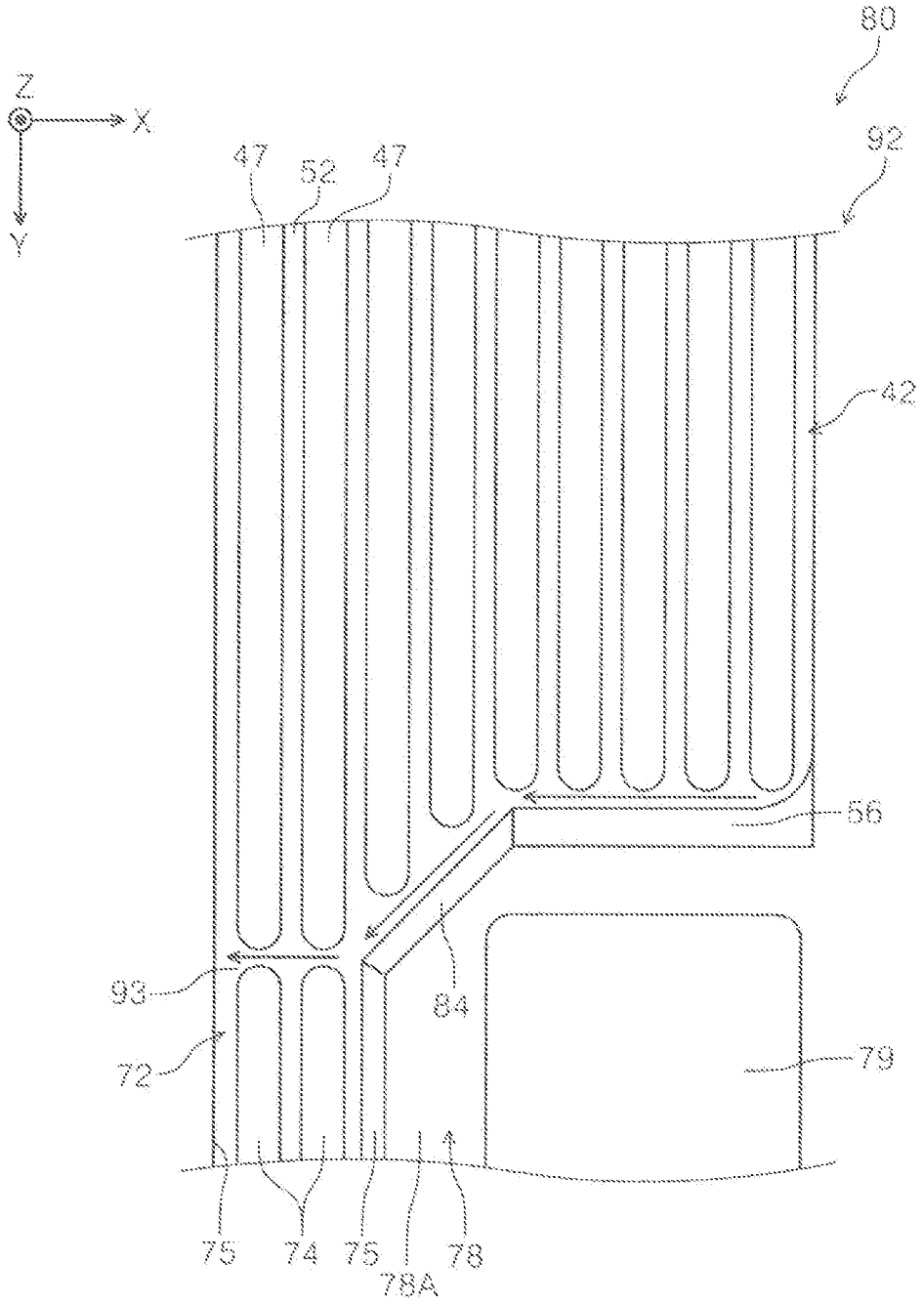
FIG. 10 is a plan view obtained by enlarging a part of the recessed portion of the printer according to a second modification example of the second exemplary embodiment.

FIG. 10 illustrates the printer 80 of a second modification example of the second exemplary embodiment. The printer 80 of the second modification example includes a platen 92. The platen 92 is different from the platen 82 (FIG. 8) in that the lengths of the plurality vertical walls 47 in the Y direction vary. Some of the plurality of vertical walls 47 positioned in the −X direction with respect to the center in the recessed portion 42 extend to the inclined surface 84. A junction portion 93 between the other of the plurality of vertical walls 47 and the vertical walls 74 forms a flow path extending along the X direction from the end position of the inclined surface 84 in the +Y direction. The arrow indicates a part of the flow of the ink Q.

Figure 11:
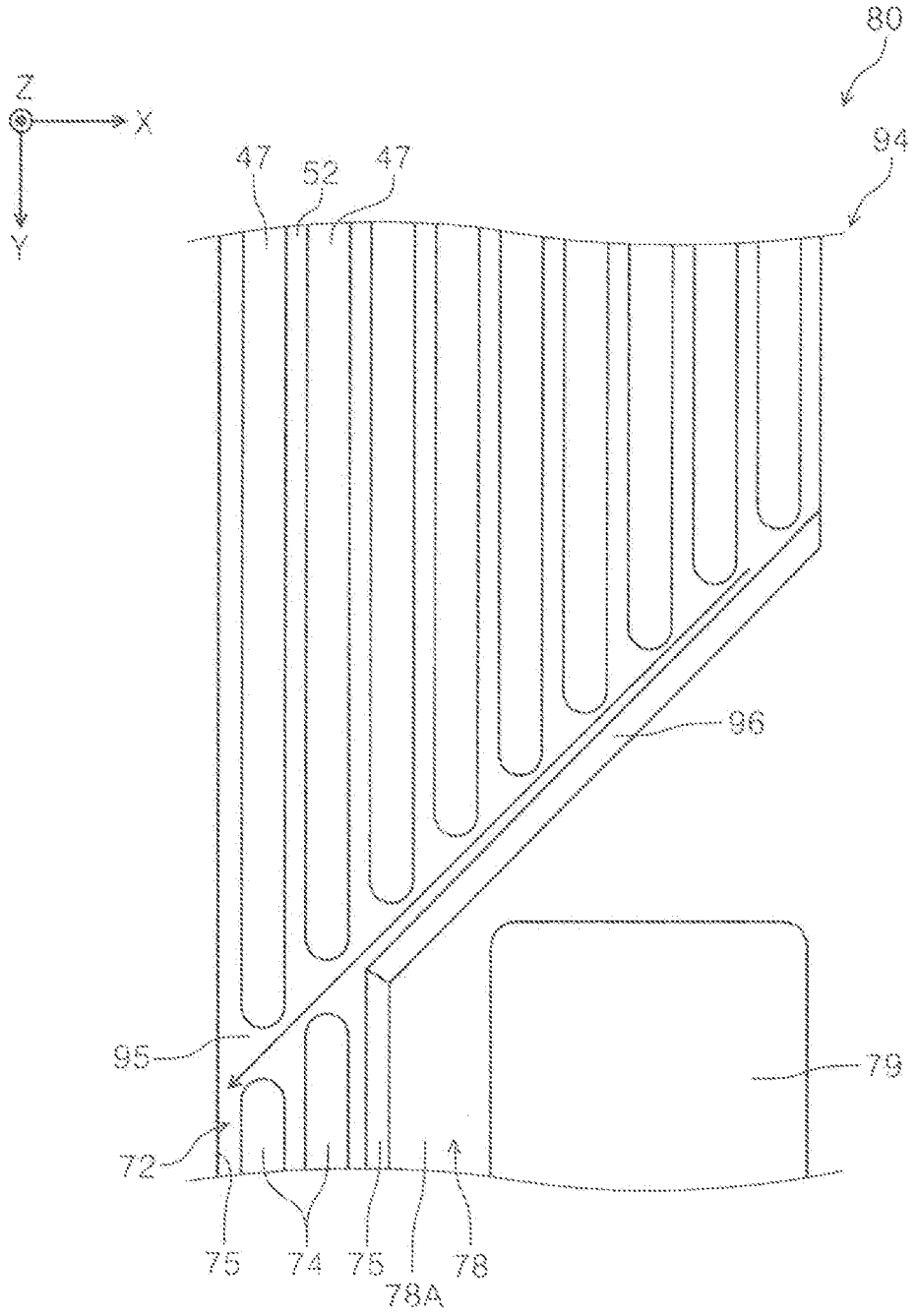
FIG. 11 is a plan view obtained by enlarging a part of the recessed portion of the printer according to a third modification example of the second exemplary embodiment.

FIG. 11 illustrates the printer 80 of a third modification example of the second exemplary embodiment. The printer 80 of the third modification example includes a platen 94. The platen 94 is different from the platen 82 (FIG. 8) in that the lengths of the plurality vertical walls 47 in the Y direction vary. The plurality of vertical walls 47 have greater lengths in the Y direction as approaching the −X direction. Further, the platen 94 includes an inclined surface 96 in place of the inclined surface 84 (FIG. 8). A length of the inclined surface 96 in the inclination direction is greater than that of the inclined surface 84. A junction portion 95 between the vertical walls 47 the vertical walls 74 arrayed in the Y direction forms a flow path along the extension direction of the inclined surface 96. The arrow indicates a part of the flow of the ink Q.

The printers 10 and 80 of the first and second exemplary embodiments of the present disclosure are based on the configurations described above. However, as a matter of course, modifications, omission, and the like may be made to a partial configuration without departing from the gist of the disclosure of the present application.

In the printers 10 and 80, the suction portion 62 may not be provided. The number of the suction ports of the suction portion 62 may be numbers other than that described in the first exemplary embodiment.

The number of the groove portions 52 in the recessed portion 42 may be numbers other than that described in the first exemplary embodiment. The groove portion 52 may not be provided in the recessed portion 42. Similarly, the number of the groove portions 76 in the discharge portion 72 may be numbers other than that described in the first exemplary embodiment. The groove portions 76 may not be provided in the discharge portion 72.

The plurality of groove portions 52 may not be coupled in the X direction at the downstream end of the recessed portion 42 in the Y direction. The first length L1 may be greater than the second length L2.

The recessed portion 42 may not be provided at the reference position A. Specifically, a method of arranging the sheet P is not limited to side registration in which the sheet P is arranged to the side in the +X direction or the −X direction, and may be center registration in which the center of the device in the X direction and the center of the sheet P are aligned.

As in the recessed portions 44 and 46, the number of the recessed portions arranged in the −X direction may be one, three, or more.

The discharge portion 72 may extend upward in the Y direction from the recessed portion 42.

The supporting surface 32 may be arranged along a direction intersecting the horizontal direction. In this case, the first bottom surface 43 and the second bottom surface 73 may be inclined in a direction intersecting the inclination direction of the supporting surface 32 and a direction in which the ink Q flows under an own weight.

The inclined surface 56 may be a wall surface standing upright in the +Z direction.

The inclined surface 84 may extend to the end of the recessed portion 42 in the +X direction. Further, in place of the inclined surface 84, the auxiliary portion 78 may be formed into a curved surface.

The recording unit 18 may be either of a serial type recording head or a line head.

What is claimed is:

1. A recording device, comprising:

a recording unit configured to eject a liquid droplet onto a recording medium transported in a transport direction to perform recording;

a supporting member being arranged to face the recording unit and including a supporting surface configured to support the recording medium;

at least one recessed portion being provided at an end of the supporting member in a width direction intersecting the transport direction and being recessed from the supporting surface, the recessed portion being configured to receive the liquid droplet ejected from the recording unit; and a discharge path being coupled to the recessed portion and being configured to discharge the liquid droplet in the recessed portion along the transport direction, wherein a width of the discharge path in the width direction is smaller than a width of the recessed portion in the width direction, and a position of the discharge path in the width direction is arranged on an inner side with respect to a position of an edge of the recording medium, and a second end side of the discharge path is arranged continuously to a first end side of the recessed portion on an extension line of the first end side, the second end side being positioned on an inner side of the recording medium in the width direction, the first end side being positioned on the inner side of the recording medium.

2. The recording device according to claim 1, wherein the supporting member is provided with a suction portion on an inner side in the width direction with respect to the recessed portion, the suction portion being configured to suck the recording medium, and the suction portion includes at least one suction port into which air flows.

3. The recording device according to claim 1, wherein a region of the supporting member where the recessed portion is provided includes a part of a recording region where the recording unit performs recording on the recording medium in the transport direction, and includes a part of non-recording regions outside of both edges of the recording medium in the width direction.

4. The recording device according to claim 1, wherein the recessed portion and the discharge path include a plurality of groove portions extending along the transport direction and being arrayed in the width direction.

5. The recording device according to claim 4, wherein the plurality of groove portions in the recessed portion are coupled in the width direction at a downstream end of the recessed portion in the transport direction, and are coupled to the discharge path.

6. The recording device according to claim 4, wherein a first length corresponding to a width of one of the groove portions in the width direction is smaller than a second length corresponding to an interval between the groove portions adjacent to each other in the width direction.

7. The recording device according to claim 1, wherein the recessed portion is provided at the supporting surface at a reference position at which one edge of the recording medium in the width direction is positioned.

8. The recording device according to claim 7, wherein the recording unit is configured to perform recording on the recording medium of a plurality of sizes having different widths in the width direction, and the recessed portion, among a plurality of the recessed portions, provided at a position other than the reference position is provided corresponding to a position of another edge of the recording medium in the width direction.

9. The recording device according to claim 1, wherein the discharge path extends downstream in the transport direction from the recessed portion.

10. The recording device according to claim 9, wherein the supporting surface is arranged along a horizontal direction, and each of a first bottom surface of the recessed portion and a second bottom surface of the discharge path is inclined such that a position thereof is lower, in a vertical direction, on a downstream side in the transport direction.

11. The recording device according to claim 1, wherein a wall surface positioned at a downstream end of the recessed portion in the transport direction is an inclined surface such that a position thereof is higher, in a vertical direction, on a downstream side in the transport direction.

12. The recording device according to claim 1, wherein an inner wall surface at an upstream end of the discharge path in the transport direction that is positioned at an outer end of the upstream end in the width direction includes an inclined surface being inclined to increase the width of the discharge path in the width direction as approaching the recessed portion.

* * * * *